US007044809B2

(12) United States Patent
Kuroda et al.

(10) Patent No.: US 7,044,809 B2
(45) Date of Patent: May 16, 2006

(54) ELECTRIC CONTACT AND HOUSING OF PLUG CONNECTOR

(75) Inventors: Keiji Kuroda, Amagasaki (JP); Kiyoshi Aramoto, Higashiosaka (JP); Ryo Moriwake, Izumiotsu (JP)

(73) Assignee: J.S.T. Mfg. Co., Ltd., Osaka (JP)

( * ) Notice: Subject to any disclaimer, the term of this patent is extended or adjusted under 35 U.S.C. 154(b) by 0 days.

(21) Appl. No.: 10/824,246

(22) Filed: Apr. 13, 2004

(65) Prior Publication Data

US 2004/0209529 A1 Oct. 21, 2004

(30) Foreign Application Priority Data

Apr. 16, 2003 (JP) ..... 2003-111971

(51) Int. Cl.
*H01R 13/40* (2006.01)

(52) U.S. Cl. ..... 439/752.5; 439/660

(58) Field of Classification Search ..... 439/884, 439/888, 891, 877, 869–873, 660, 733.1, 439/752.5

See application file for complete search history.

(56) References Cited

U.S. PATENT DOCUMENTS 3,474,380 A * 10/1969 Miller ..... 439/884
5,993,263 A * 11/1999 Sampson ..... 439/660
6,045,408 A * 4/2000 Takemasa ..... 439/660
6,071,152 A * 6/2000 Achammer et al. ..... 439/733.1
6,129,565 A * 10/2000 Lai ..... 439/884
6,488,541 B1 * 12/2002 Takeuchi ..... 439/660
6,786,781 B1 * 9/2004 Sai et al. ..... 439/884

FOREIGN PATENT DOCUMENTS

| | | |
|---|---|---|
| JP | 08162191 | 6/1996 |
| JP | 10294145 | 11/1998 |
| JP | 3046731 | 3/2000 |

* cited by examiner

*Primary Examiner*—Tho D. Ta
*Assistant Examiner*—Felix O. Figueora
(74) *Attorney, Agent, or Firm*—W. F. Fasse; W. G. Fasse

(57) ABSTRACT

An electric contact of a plug connector is formed by folding a blank, and is inserted into a receiving cell of a housing and fitted to the housing. The electric contact includes a tab formed of a base plate and a contact plate folded so as to overlap one another in the thickness direction. The rear end of the base plate includes a protruding part that protrudes beyond the rear end of the contact plate in the depth direction. When the contact body is set in the receiving cell of the housing, the base plate of the tab protruding out of the receiving cell is supported by the housing, and the protruding part of the base plate is fitted in and held by the housing to prevent the tab from lifting from the housing in the thickness direction.

9 Claims, 17 Drawing Sheets

ELECTRIC CONTACT AND HOUSING OF PLUG CONNECTOR

BACKGROUND OF THE INVENTION

1. Field of the Invention

The present invention belongs to the field of plug connectors having electric contacts of the crimping type, and relates to the structure of the tab of the electric contact and the structure of the housing corresponding to it.

2. Related Art

Japanese Patent Publication No. 3046731 discloses a male terminal comprising an electric wire connecting part to be connected to an end of an electric wire, an electric contact part being formed by folding one free edge of a base part over the base part and overlapping them together and to be electrically connected to a counterpart terminal, a fitting part being provided between the electric wire connecting part and the electric contact part and to be fitted on a terminal receiving cell when the terminal is received in the connector, and a joining part connecting the fitting part and the electric contact part. In the case of this male terminal, the joining part comprises a lower piece being extended from the base part toward the fitting part and being wider than the base part and an upper piece being extended from the one free edge part toward the fitting part, to be folded toward the lower piece when the one free edge part is folded over and overlapped with the base part and being wider than the one free edge part.

Japanese Patent Unexamined Publication Heisei 10-294145 discloses a connector that comprises a connecting terminal and a housing. The connecting terminal comprises an elongated tab-shaped contact part to be inserted into a terminal receiving cell of the housing made of resin to protrude into a hood part, a fixing part to fix an end of an electric wire, and a fitting part having a fitting hole made in the lower face of an approximately central part for fitting with a flexible fitting piece provided on the housing. The housing has a contact part fitting-in hole. The contact part fitting-in hole is opened in an inner wall constituting the inner part of the hood part into which a counterpart connector is fitted, and the tab-shaped contacting part is passed through the contacting part fitting-in hole. In the case of this connector, a sway-preventing piece protruding toward the tab-shaped contacting part side is formed on the connecting terminal, near the joining part between the tab-shaped contacting part and the fitting part, on the side of the fitting part. And a supporting part, to which the sway-preventing piece of the connecting terminal contacts, is formed on a side in the contacting part fitting-in hole in the housing.

In both cases of the male terminal of Japanese Patent Publication No. 3046731 and the connecting terminal of Japanese Patent Unexamined Publication Heisei 10-294145, the male terminal or the connecting terminal is inserted into a terminal receiving cell in the housing of the plug connector, the electric contact part or the tab-shaped contact part protruding out of the terminal receiving cell is inserted into a tube-shaped female terminal of the receptacle connector to achieve the mechanical connection and the electric connection between the male terminal and the female terminal, and the contact pressure between the male terminal and the female terminal is secured by the elastic restoring force of a leaf spring provided inside the female terminal.

SUMMARY OF THE INVENTION

When an electric contact of the crimp-type is used, the thinner is the electric wire to be connected, the thinner must be the plate thickness of the barrel. This is to ensure that when the electric wire is crimped by the barrel, the barrel is deformed exactly according to the forms of the bunch of core wires, and the barrel securely bites into the bunch of core wires to secure joining strength between the barrel and the bunch of core wires and reduce the electric contact resistance. However, when the electric contact is formed by folding a blank of a certain configuration, reducing the thickness of the blank for securing the crimping function of the barrel may result in insufficient strength of the tab, in turn, deformation of the tab and eventually defective fitting-in or failed fitting-in of the plug connector and the receptacle connector.

Hence the present inventors proposed a plug connector wherein one face in the thickness direction of a tab protruding out of the receiving cell of the housing of the plug connector is supported by a supporting wall of the housing, the tab and the supporting wall are inserted together into a cavity of the receptacle connector, and the electric contact of the receptacle connector is made to contact the other face in the thickness direction of the tab. With this arrangement, the defects due to insufficient strength of the tab can be prevented by supporting the tab with the supporting wall.

In that case, however, if the strength of the tab is low, the tab tends to be deformed when, for example, an operator holds the electric contacts in a bunch. Moreover, the tab tends to be deformed in a process of inserting the electric contact with electric wire crimped into a receiving cell of the housing of the plug connector.

When the electric contacts are set in the housing, if a tab lifts from the supporting wall, the lifted tab may hit against an electric contact or another part of the receptacle connector, causing troubles, namely, defective fitting-in or failure of fitting-in between the plug connector and the receptacle connector.

The present invention was made in view of such points, and its objective is to construct the tab with two plates by folding a part of a blank and overlapping them in the thickness direction so as to reconcile securing the barrel's function of crimping thin wire and improving the strength of the tab, and to fit the top end of the tab on the housing so as to prevent the tab from lifting from the supporting wall, and in turn as a whole, to provide an electric contact of plug connector and a housing corresponding to it, which can prevent defective fitting-in or failure of fitting-in between the plug connector and the receptacle connector by preventing tab deformation through enhancement in tab strength and preventing the tab from lifting from the supporting wall.

To accomplish the objective, the electric contact of plug connector of the present invention is an electric contact of plug connector formed by folding a blank of a certain configuration to be inserted into a receiving cell of a housing having the receiving cell and fitted on the housing. When a depth direction, a width direction and a thickness direction all being perpendicular to each other are assumed, the electric contact of plug connector comprises a body having a barrel for crimping an electric wire, and a tab extending rearward in the depth direction from the body, the tab comprises two plates formed by folding a part of the blank and overlapping them in the thickness direction, one plate providing a base plate and the other plate providing a contact plate for contacting a counterpart electric contact, the rear end in the depth direction of the base plate protruding rearward beyond the rear end in the depth direction of the contact plate and forming a protruding part, and the electric contact being arranged in that when the body is set in the receiving cell of the housing, the base plate of the tab protruding out of the receiving cell is supported by the housing, and the protruding part is fitted on the housing so that the tab does not lift in the thickness direction from the housing.

When this electric contact is set in the housing, the tab and a part of the housing for supporting the base plate of the tab are inserted together into a cavity of the receptacle connector, and the electric contact of the receptacle connector is made to contact the contact plate of the tab, the electric contact of the plug connector and the electric contact of the receptacle connector will make mechanical connection and electric connection. In that case, as the base plate of the tab is supported by the housing, deformation of the tab due to a contact pressure between the electric contact of the plug connector and the electric contact of the receptacle connector will be avoided, thus troubles, namely, defective fitting-in or failure of fitting-in between the plug connector and the receptacle connector can be prevented.

As the tab comprises two plates formed by folding a part of a blank and overlapping them in thickness direction, even when the thickness of the blank is set low to secure the barrel's function of crimping thin wire, the strength of the tab is enhanced. Moreover, as the protruding part is fitted on the housing, the tab does not lift in the thickness direction from the housing. Thus defective fitting-in or failure of fitting-in between the plug connector and the receptacle connector is prevented through prevention of deformation by enhancing the tab strength and prevention of lifting of the tab from the housing.

In the electric contact of plug connector according to the present invention the tab comprises two plates, namely, the contact plate and the base plate, being formed by folding a part of a blank and overlapping them in the thickness direction, the base plate of the tab protruding out of the receiving cell is supported by the housing, and the protruding part of the base plate is fitted on the housing to prevent the tab from lifting in the thickness direction from the housing. This reconciles assurance of the barrel's function of crimping thin wire and enhancement in tab strength. With prevention of deformation through enhancement in tab strength and prevention of tab lifting from the housing, an electric contact of plug connector is successfully provided, which can prevent defective fitting-in or failure of fitting-in between the plug connector and the receptacle connector.

The housing of plug connector according to the present invention is a housing of plug connector into which the electric contact of plug connector according to the present invention is inserted and on which the electric contact is fitted. When a depth direction, a width direction and a thickness direction all being perpendicular to each other are assumed, the housing of plug connector comprises a receiving body having a receiving cell into which the electric contact with electric wire connected thereto is inserted, a supporting wall extending rearward in the depth direction from a part on one side in the thickness direction of the receiving cell of the receiving body and supporting the base plate of the electric contact on one face of both faces in the thickness direction, a top end wall rising on the one face of the supporting wall at the rear side in the depth direction of the supporting wall, and a fitting wall extending frontward in the depth direction from the top end wall, being spaced from the one face of the supporting wall in the thickness direction by a distance equal to or greater than the thickness of the blank of the electric contact, and contacting the protruding part of the tab to restrict the tab from lifting from the supporting wall.

When the electric contact of plug connector according to the present invention is set in the housing, the tab of the electric contact and the supporting wall of the housing are inserted together into the cavity of the receptacle connector, and the electric contact of the receptacle connector is made to contact the contact plate of the tab, the electric contact of the plug connector and the electric contact of the receptacle connector will make mechanical connection and electric connection. In that case, as the base plate of the tab is supported by the supporting wall of the housing, deformation of the tab due to the contact pressure between the electric contact of the plug connector and the electric contact of the receptacle connector will be avoided, and generation of troubles, namely, defective fitting-in or failure of fitting-in between the plug connector and the receptacle connector will be prevented.

As the tab of the electric contact comprises two plates formed by folding a part of the blank and overlapping them in the thickness direction, even if the thickness of the blank is set low to secure the barrel's function of crimping thin wire, the tab strength will be enhanced. Moreover, as the protruding part is fitted on the fitting wall, the tab will not lift in the thickness direction from the supporting wall. Thus through prevention of deformation by increasing the tab strength and prevention of the tab from lifting from the supporting wall, defective fitting-in or failure of fitting-in between the plug connector and the receptacle connector is prevented.

When the tab of the electric contact and the supporting wall of the housing are inserted together into the cavity of the receptacle connector, the electric contact of the receptacle connector will be pushed away in the thickness direction by the top end wall, and connection of both connectors will be done smoothly.

As the housing of plug connector according to the present invention is the housing of plug connector into which the electric contact of plug connector of the present invention is inserted and on which these electric contact is fitted, and the housing comprises the receiving body, the supporting wall, the top end wall and the fitting wall, the present inventors were able to provide a housing of plug connector that can reconcile securing the function of crimping thin wire by barrel of the electric contact and enhancing the strength of the tab, and in turn, can prevent defective fitting-in or failure of fitting-in between the plug connector and the receptacle connector by prevention of the deformation through the tab strength enhancement and prevention of tab lifting from the supporting wall. Moreover, with the guiding function of the top end wall, connection of both connectors can be done smoothly.

DESCRIPTION OF PREFERRED EMBODIMENTS OF THE INVENTION

Figure 1:
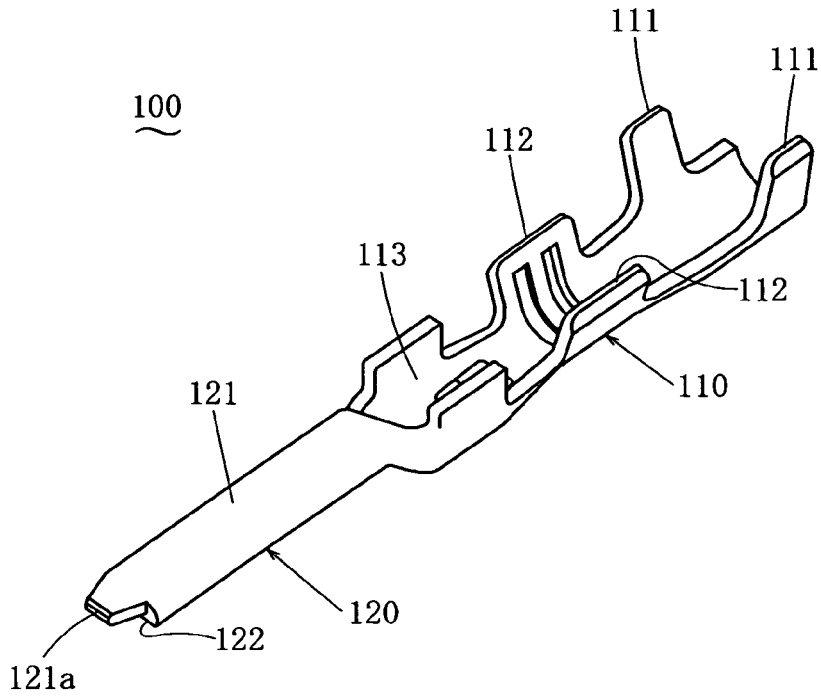
FIG. 1 is an enlarged perspective view of the electric contact of the first embodiment.
Figure 2:
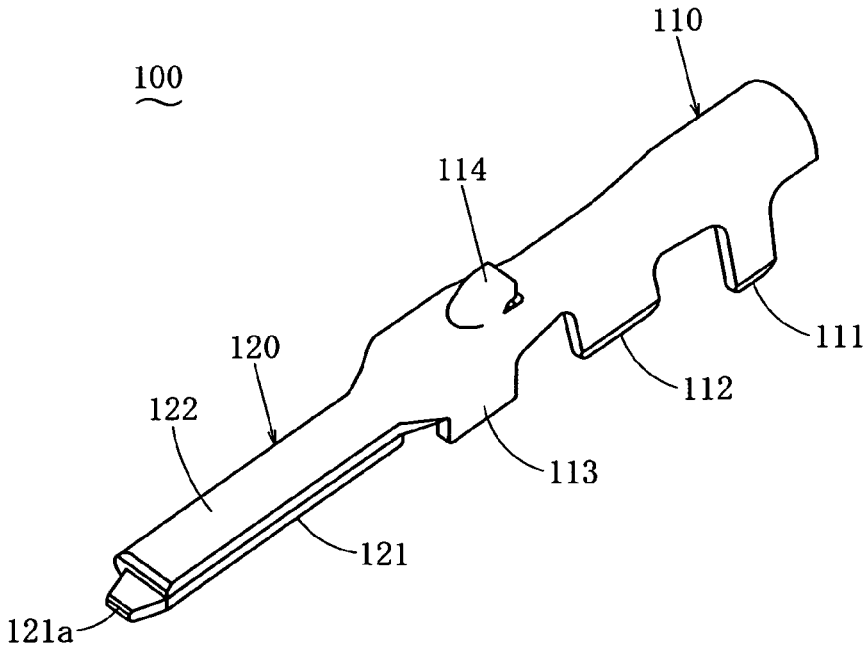
FIG. 2 is an enlarged perspective view of the electric contact of the first embodiment seen from a viewpoint opposite to that of FIG. 1.
Figure 3:
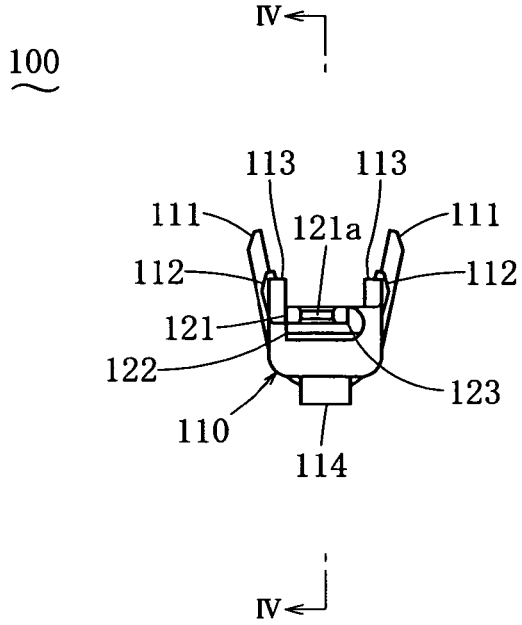
FIG. 3 is an enlarged view of the electric contact of the first embodiment seen from the rear side in the depth direction.
Figure 4:
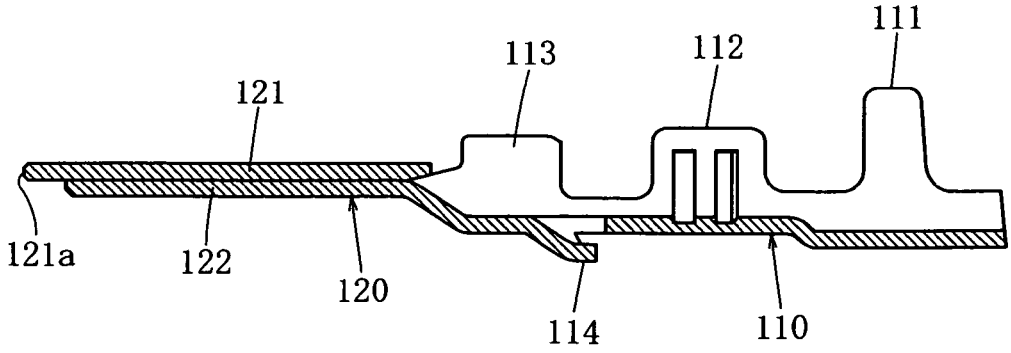
FIG. 4 is a sectional view along the line IV—IV of FIG. 3.
Figure 5:
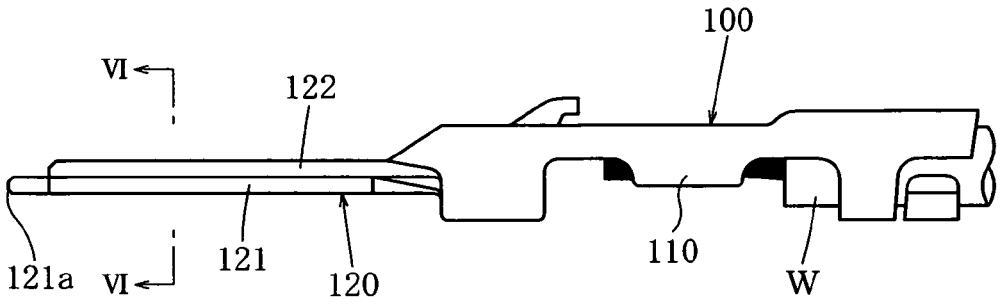
FIG. 5 is an enlarged view of the electric contact of the first embodiment with an electric wire crimped thereto seen in the width direction.
Figure 6:
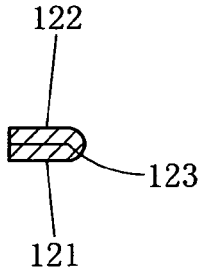
FIG. 6 is a sectional view along the line VI—VI of FIG. 5.
Figure 7:
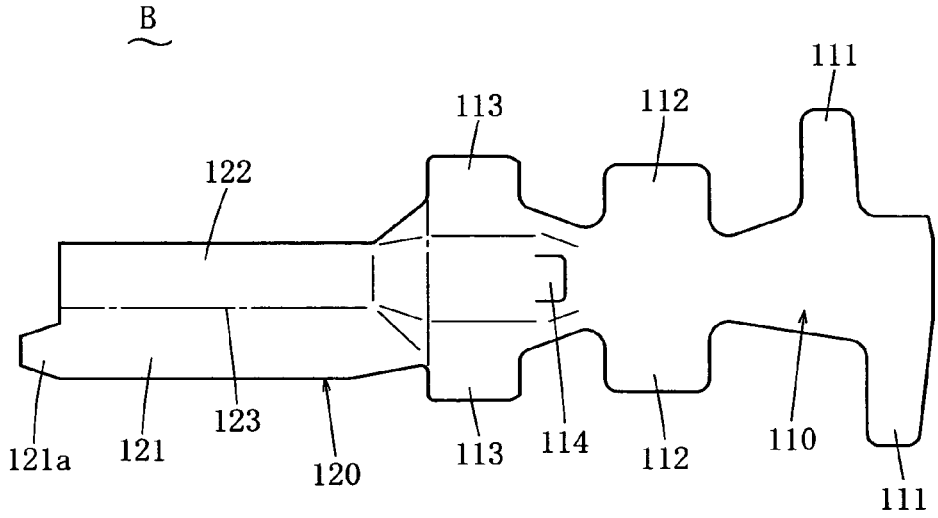
FIG. 7 is an enlarged view showing the blank of the electric contact of the first embodiment.
Figure 8:
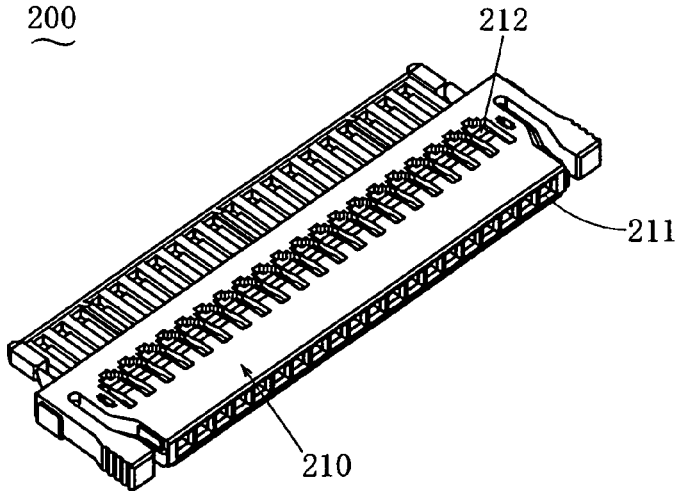
FIG. 8 is a perspective view showing the housing of the plug connector of the first embodiment.

In the following, some embodiments of the present invention will be described. FIG. 1 through FIG. 4 show an electric contact 100 of plug connector PC of the first embodiment of the present invention. This electric contact 100 is formed by folding a blank B of a certain configuration as shown in FIG. 7. This blank B can be obtained by, for example, punching a thin sheet of a certain thickness. This electric contact 100 is inserted, after an electric wire W is crimped thereto as shown in FIG. 5, into a housing 200 having receiving cells 211, which will be described later; the electric contacts 100 are inserted into the receiving cells 211 and fitted on the housing 200 to complete the plug connector PC. This plug connector PC is to be connected to a counterpart receptacle connector RC. The receptacle connector is to be mounted on a printed circuit board such as, for example, a liquid crystal panel. The object to which the receptacle connector is to be connected is not limited in any way by this embodiment.

The electric contact 100 is formed of a conductive material. The electric contact 100 comprises a body 110 having barrels for crimping an electric wire W and a tab 120 extending rearward in the depth direction from the body 110. A depth direction, a width direction and a thickness direction all being perpendicular to each other are assumed, and the following description is given by using this orientation. In the case of this embodiment, with reference to FIG. 4, the left-right direction in FIG. 4 is the depth direction, and the right in FIG. 4 is the front in the depth direction and the left is the rear in the depth direction. The left-right direction in FIG. 3 is the width direction, and the top-bottom direction in FIG. 3 is the thickness direction. The body 110 is made by forming a blank B into an approximately U-shape seen in the depth direction, but the configuration of the body is not limited to this configuration. Barrels are of the widely known type, and they are of two kinds. One is an insulation barrel 111, which crimps the insulation of the electric wire W to connect with it. The other one is a wire barrel 112, which crimps the core wire of the electric wire W to connect with it. Each barrel is formed of plate pieces rising from both sides in the width direction of the body 110. These plate pieces are substantially facing in the width direction, and they are deformed to fall inward in the width direction to crimp the electric wire W and connect with it (refer to FIG. 5).

The tab 120 comprises two plates that are formed by folding a part of the blank B to overlap the two plates in the thickness direction. One plate provides a base plate 121, and the other plate provides a contact plate 122 that is to contact a counterpart electric contact 300.

The base plate 121 and the contact plate 122 are folded along a boundary line 123 extending in the depth direction at one edge in the width direction. This boundary line 123 is an imaginary line indicated to specify the part to be folded.

A part of the body 110 being adjacent to the tab 120 is greater at least in one dimension of the dimension in the width direction and the dimension in the thickness direction than that of the tab 120 to provide a fit-in part 113 for fitting in the receiving cell 211 of the housing 200 that will be described later. In other words, the clearance between the body 110 of the electric contact 100 and the receiving cell 211 of the housing 200 is set the smallest at this fit-in part 113, and the position of the electric contact 100 in relation to the housing 200 is established by the fitting-in of the fit-in part 113 and the receiving cell 211. The present invention includes an embodiment of the electric contact wherein the body 110 is provided with a fit-in part in a part other than the part adjacent to the tab 120, an embodiment of the electric contact wherein the body 110 is arranged to be fitted in the receiving cell with a substantially even clearance entirely rather than providing a fit-in part in a part, and an embodiment of the electric contact which is inserted into the receiving cell of the housing and fitted on the housing but not fitted in the housing.

The rearward end in the depth direction of the base plate 121 protrudes rearward beyond the rearward end in the depth direction of the contact plate 122 to provide a protruding part 121*a*. This protruding part 121*a* is inserted into the space on the inner side in the thickness direction of a fitting wall 240 of the housing 200, which will be described later. Hence it is preferable to chamfer or R-chamfer both edges in the thickness direction and both edges in the width direction of the protruding part 121*a*. The present invention, however, includes embodiments wherein no such chamfer nor R-chamfer is provided.

As the electric contact 100 is formed by folding a blank B of a certain configuration, the thicknesses of the base plate 121, the protruding part 121*a* being a part thereof, and the contact plate 122 are identical to the thickness t of the blank B.

Due to the above-mentioned configuration, when the body 110 is placed in the receiving cell 211 of the housing 200, the base plate 121 of the tab 120 protruding out of the receiving cell 211 will be supported by the housing 200, and the protruding part 121*a* will be fitted on the housing 200 to prevent the tab 120 from lifting from the housing 200 in the thickness direction.

Figure 9:
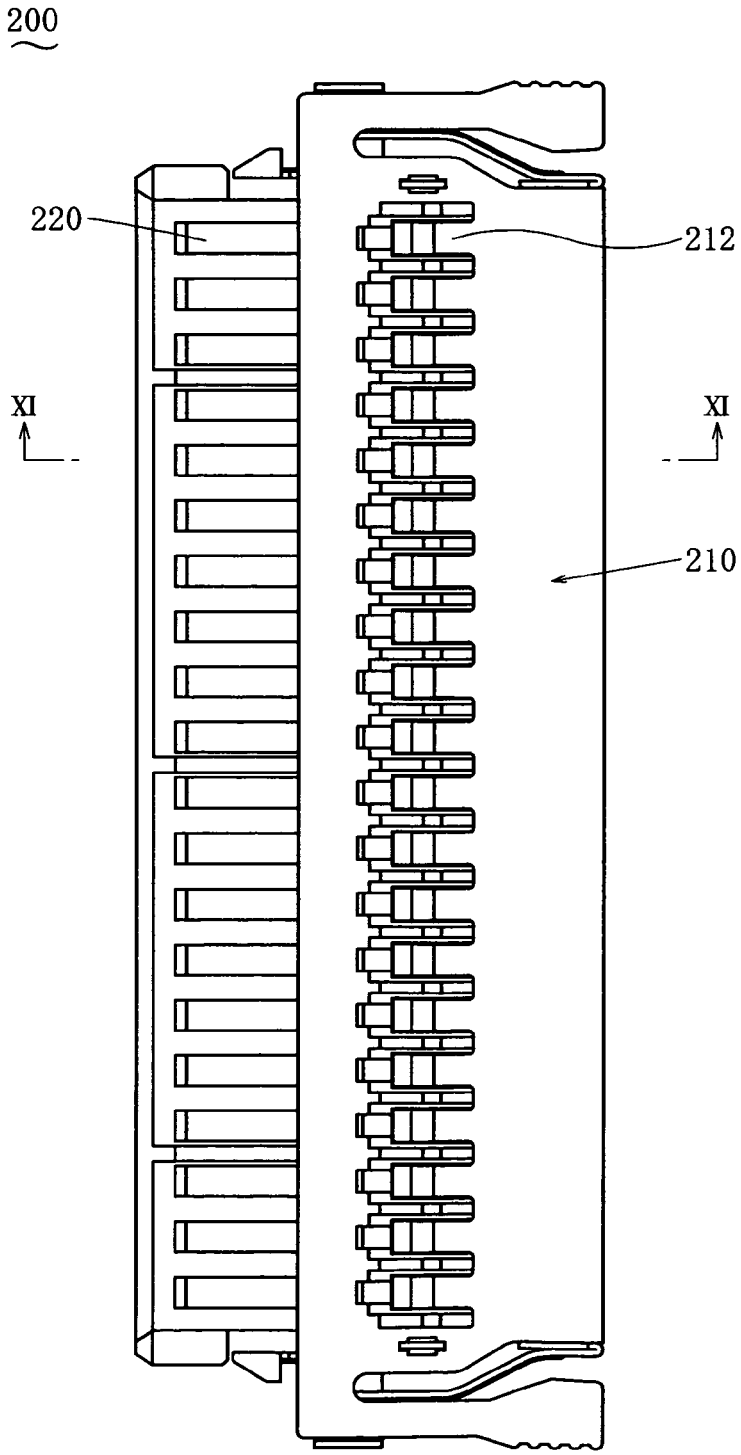
FIG. 9 is an enlarged view of the housing of the plug connector of the first embodiment seen in the thickness direction.
Figure 10:
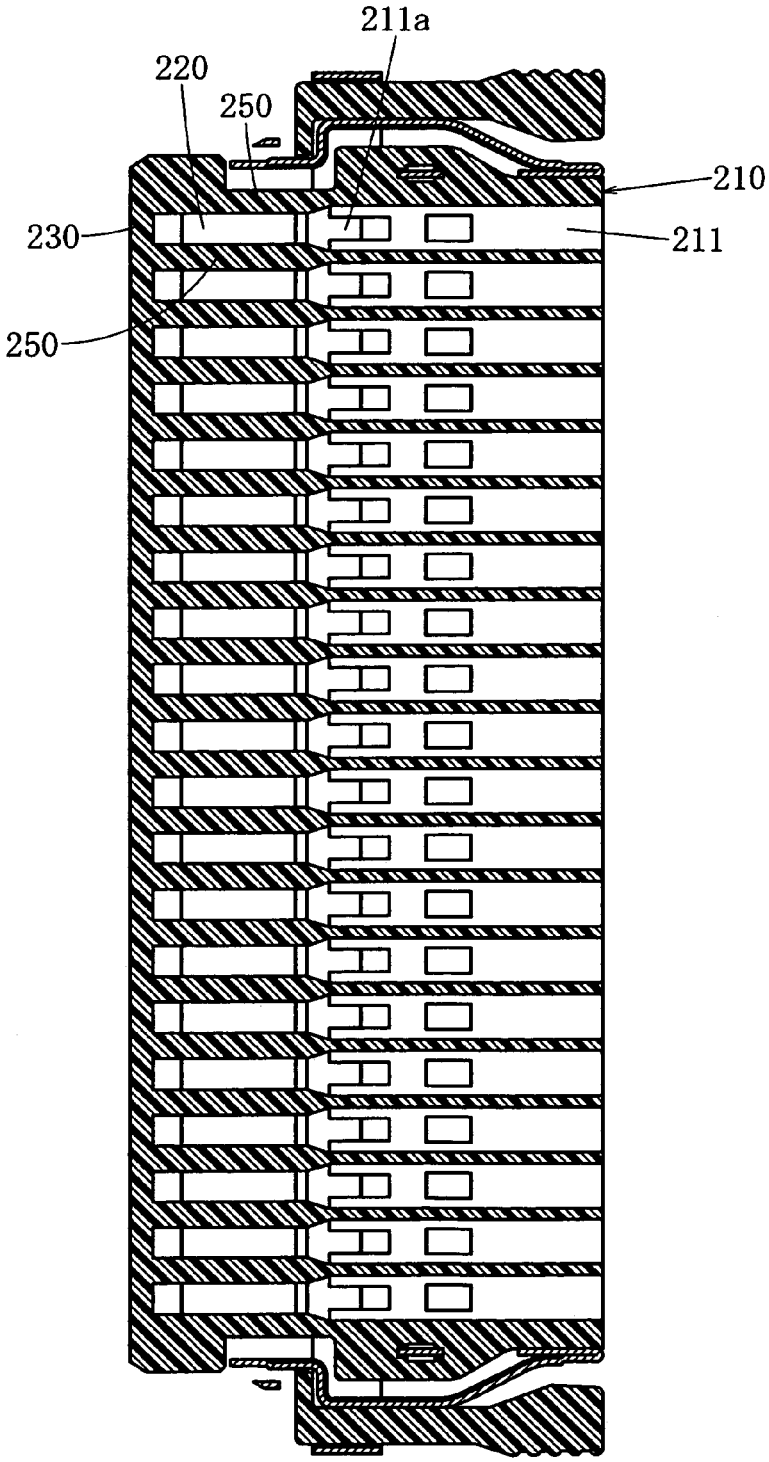
FIG. 10 is a sectional enlarged view of the housing of the plug connector of the first embodiment sectioned in a plane perpendicular to the thickness direction and seen in the thickness direction.
Figure 11:
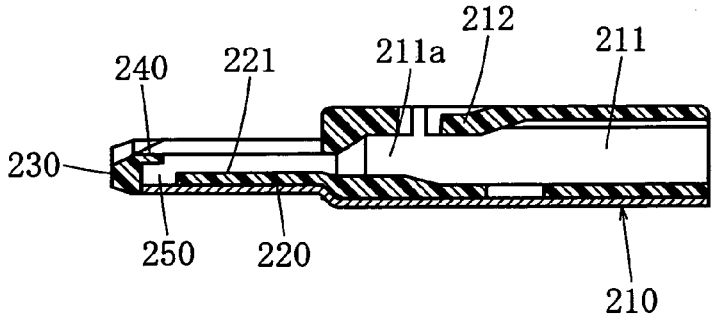
FIG. 11 is a sectional view along the line XI—XI of FIG. 9.

FIG. 8 through FIG. 11 show the housing 200 of the plug connector PC into which the electric contact 100 is inserted and on which the electric contact 100 is fitted. The orientation in the housing 200 is similar to the orientation described above. With reference to FIG. 9, the left-right direction of the diagram is the depth direction, and the right of the diagram is the front in the depth direction, and the left of the diagram is the rear in the depth direction. The top-bottom direction of FIG. 9 is the width direction, and a direction perpendicular to the plane of the paper is the thickness direction. Although the plug connector PC of this embodiment is of the 20 pole type wherein twenty electric contacts 100 are mounted, the number of poles of the housing of the present invention is not limited in any way by that. The present invention includes single pole type plug connector.

At least parts of the housing 200 that contact the electric contacts 100 are formed of an insulating material. A shell of metal, etc. may be provided in some part of the housing 200 when necessary. The housing 200 comprises a receiving body 210 having receiving cells 211, into which electric contacts 100 with electric wires W connected thereto are inserted, a supporting wall 220 extending from the receiving body 210, a top end wall 230 provided on the supporting wall 220, and a fitting wall 240 extending from the top end wall 230.

Each receiving cell 211 is provided to penetrate through the receiving body 210 in the depth direction. The receiving cell 211 is provided in such a way that when the electric contact 100 with the electric wire W connected thereto is inserted, with the tab 120 at the head, into the receiving cell 211 from the front in the depth direction, the tab 120 will protrude from the receiving cell 211 rearward in the depth direction and the body 110 will stay inside the receiving cell 211. If the rearward end in the depth direction of the receiving cell 211 is made tapered toward the opening, when the electric contact 100 is inserted, a part of the body 110 of the electric contact adjacent to the tab 120 will rest there to position the electric contact 100 in relation to the housing 200, but the present invention does not limit the structure of the receiving body to such a structure.

Figure 14:
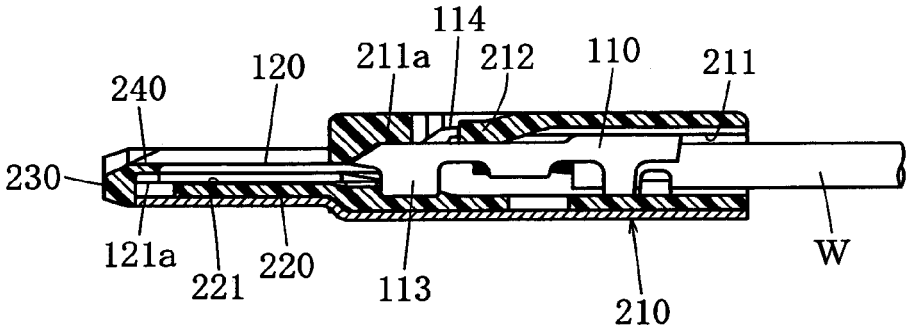
FIG. 14 is an enlarged sectional view of the plug connector of the first embodiment of FIG. 13 sectioned in a plane perpendicular to the width direction and seen in the width direction.
Figure 15:
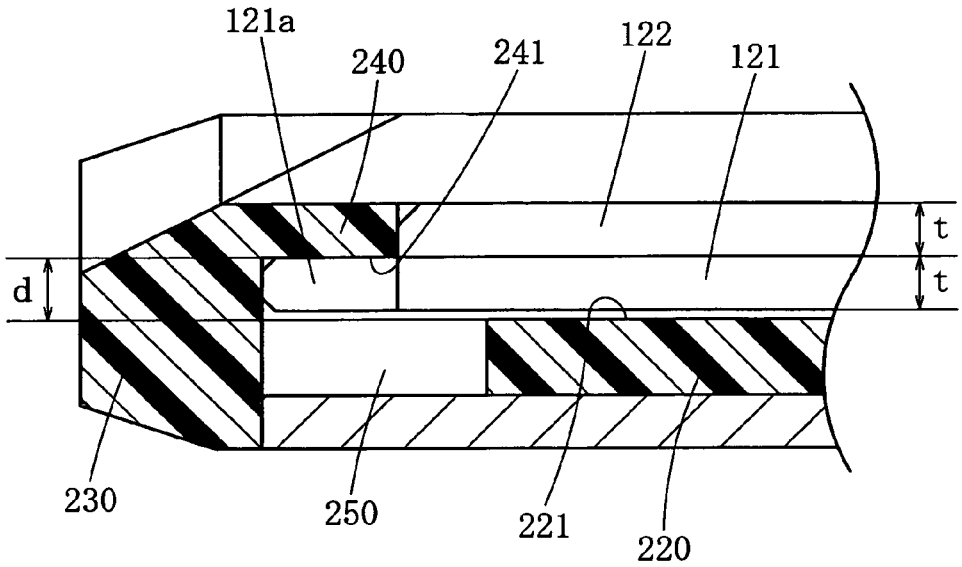
FIG. 15 is an enlarged view of a part of FIG. 14.

As shown in FIG. 14 and FIG. 15, the supporting wall 220 extends rearward in the depth direction from a part on one side in the thickness direction of the parts constituting the receiving cells 211 in the receiving body 210. The supporting wall 220 supports, with a face 221 being one of the both faces in the thickness direction thereof, the base plate 121 of the electric contact 100. The top end wall 230 rises at the rear side in the depth direction of the supporting wall 220 on the one face 221. The fitting wall 240 extends from the top end wall 230 frontward in the depth direction. This fitting wall 240 is spaced from the one face 221 of the supporting wall 220 at a distance d in the thickness direction, the distance d being equal to or greater than the thickness t of the blank B of the electric contact 100. In other words, the inner face 241 of the fitting wall 240 and the one face 221 of the supporting wall 220 are set at the distance d in the thickness direction. In the case of this embodiment, this distance d is set to exceed the thickness t of the blank B just a little. In short, what is required is that when the electric contact 100 is inserted rearward in the depth direction along the supporting wall 220, the protruding part 121*a* can be inserted without any difficulty into the space on the inner side in the thickness direction of the fitting wall 240 and touch the inner face 241 of the fitting wall 240. With this arrangement, the fitting wall 240 will contact one face in the thickness direction of the protruding part 121*a* of the electric contact 100 and can restrict the tab 120 from lifting from the supporting wall 220.

The electric contacts 100 and the housing 200 are provided with fitting structures for fitting the electric contacts 100 on the housing 200. In the case of this embodiment, the body 110 of the electric contact 100 is provided with a to-be-fitted-on part 114 that is provided to protrude therefrom, and the housing 200 is provided with elastic pieces 212 for fitting on the to-be-fitted-on parts 114; thus the housing lance structure is used. Besides this, the so-called contact lance structure may be used wherein the housing is provided with to-be-fitted-on parts and each electric contact is provided with an elastic piece for fitting on the to-be-fitted-on part.

The supporting wall 220 is provided with cross walls 250. The cross walls 250 rise in the thickness direction on both sides in the width direction of the certain part of the supporting wall 220 for supporting the base plate 121 of the electric contact 100. The cross walls 250 are spaced from each other by the width of the electric contact 100 in the width direction. The present invention includes embodiments wherein this cross wall 250 is not provided.

The thickness of the fitting wall 240 is set substantially identical to the thickness t of the blank B of the electric contact 100. This prevents generation of a gap between the contact plate 122 and the fitting wall 240 when the electric contact 100 is mounted on the housing 200. The present invention includes embodiments wherein the thickness of the fitting wall 240 is set greater than the thickness of the blank B of the electric contact 100 and embodiments wherein the thickness of the fitting wall 240 is smaller than the thickness of the blank B of the electric contact 100. In the case of the latter, it is preferable that the edges of the rear end in the depth direction of the contact plate 122 are chamfered or R-chamfered to prevent generation of any gap with edge between the fitting wall 240 and the contact plate 122.

An accepting part 211*a*, into which the fitting-in part 113 of the electric contact 100 fits, is provided at the rear end of the receiving cell 211 of the receiving body 210. The present invention includes embodiments of the housing wherein an accepting part is provided in a part other than the rear end of the receiving cell 211, embodiments of the housing wherein the body of the electric contact is fitted into the receiving cell 211 with substantially even clearance as a whole without providing an accepting part in a part, and embodiments of the housing wherein the electric contact is inserted into and fitted on the receiving cell but not fitted in the receiving cell.

Figure 12:
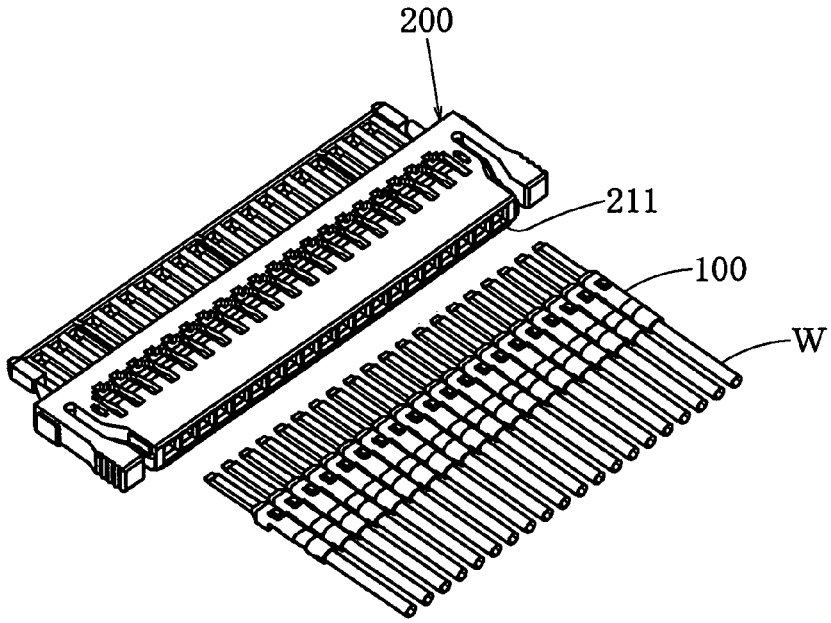
FIG. 12 is a perspective view showing the state of inserting electric contacts with electric wires crimped thereto into the housing of the plug connector of the first embodiment.
Figure 13:
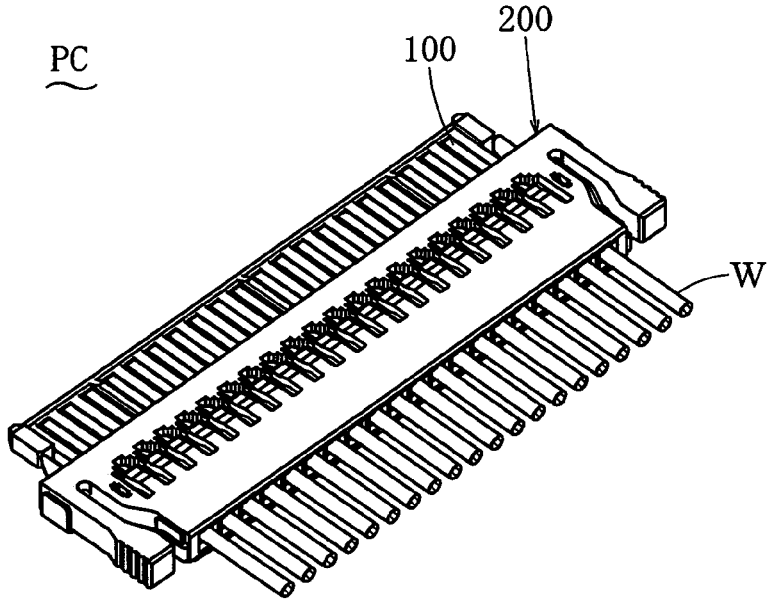
FIG. 13 is a perspective view showing the state of the housing of the plug connector of the first embodiment into which electric contacts with electric wires crimped thereto have been inserted.

As shown in FIG. 12 and FIG. 13, when electric contacts with electric wire W crimped are inserted into the receiving cells 211 of the housing 200, the electric contacts 100 will be fitted on the housing 200 by the fitting structure and the plug connector PC will be completed.

Figure 16:
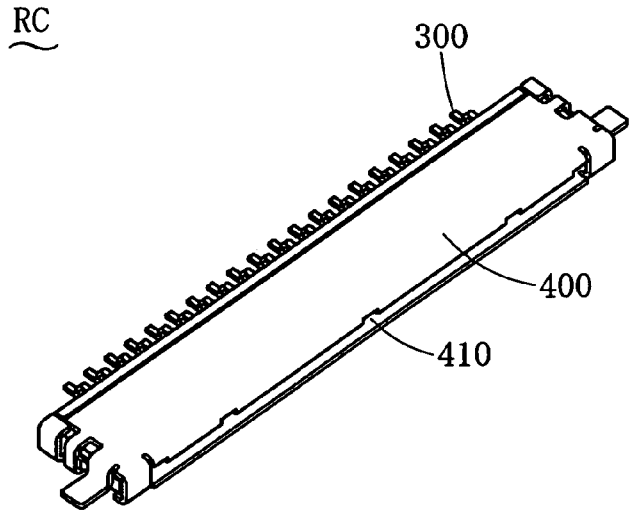
FIG. 16 is a perspective view of the receptacle connector of the first embodiment.
Figure 17:
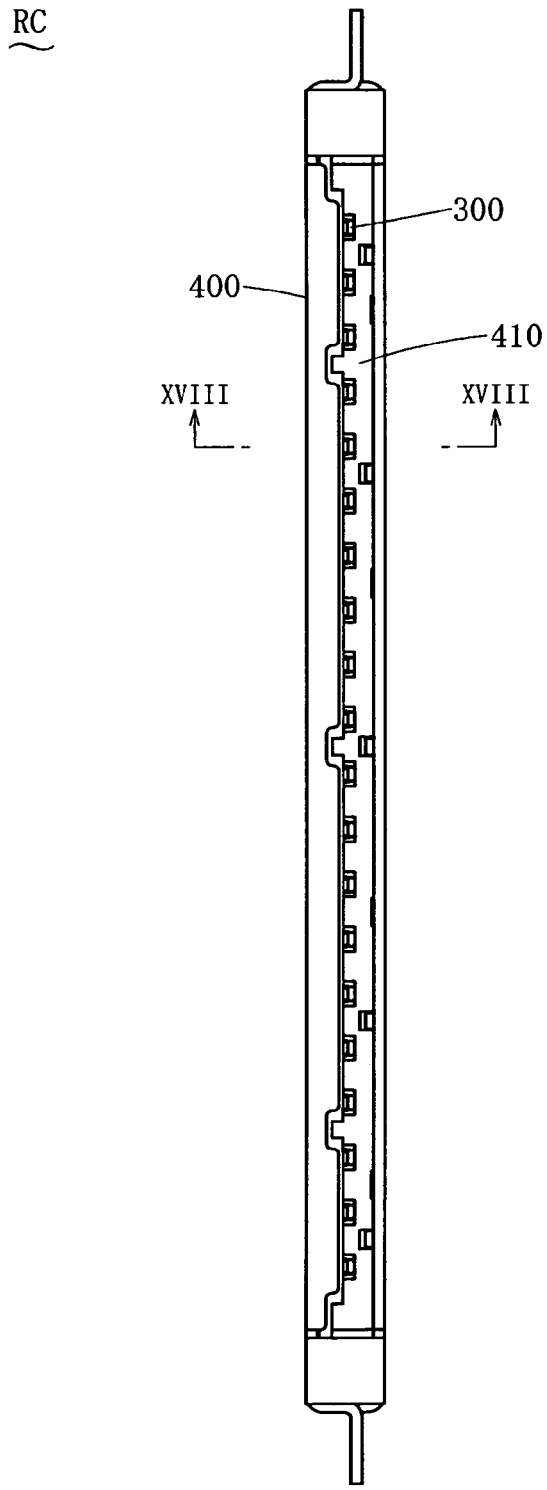
FIG. 17 is an enlarged view of the receptacle connector of the first embodiment seen from the front in the depth direction.
Figure 18:
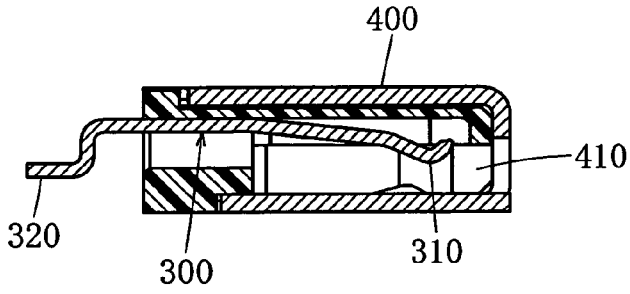
FIG. 18 is a sectional view along the line XVIII—XVIII of FIG. 17.

As shown in FIG. 16 through FIG. 18, the receptacle connector RC comprises electric contacts 300 and a housing 400 in which the electric contacts 300 are set. The orientation for this receptacle connector RC is similar to the orientation described above. With reference to FIG. 18, the left-right direction in the diagram is the depth direction, the right in the diagram is the front in the depth direction, and the left in the diagram is the rear in the depth direction. The top-bottom direction in FIG. 17 is the width direction, and the left-right direction in the diagram is the thickness direction. The number of poles is set in accordance with the number of poles of the plug connector PC. At least parts of the housing 400 that contact the electric contacts 300 are formed of an insulating material. A shell of metal, etc. may be provided partly when necessary. The housing 400 is provided with a cavity 410 that opens frontward in the depth direction. The electric contact 300 is formed of a conductive material and shaped into a rod. A contact part 310, which contacts the contact plate 122 of the electric contact 100 of the plug connector PC, is provided at one end of the electric contact 300, and a connecting part 320, which is connected to a counterpart member such as a printed circuit board P, is provided at the other end. The electric contact 300 is set in the housing in such a way that its contact part 310 can undergo elastic deformation and be displaced in the thickness direction in the cavity 410, for example, its intermediate part may be fixed onto the housing 400; thus the contact pressure is derived from the elastic restoring force.

Figure 19:
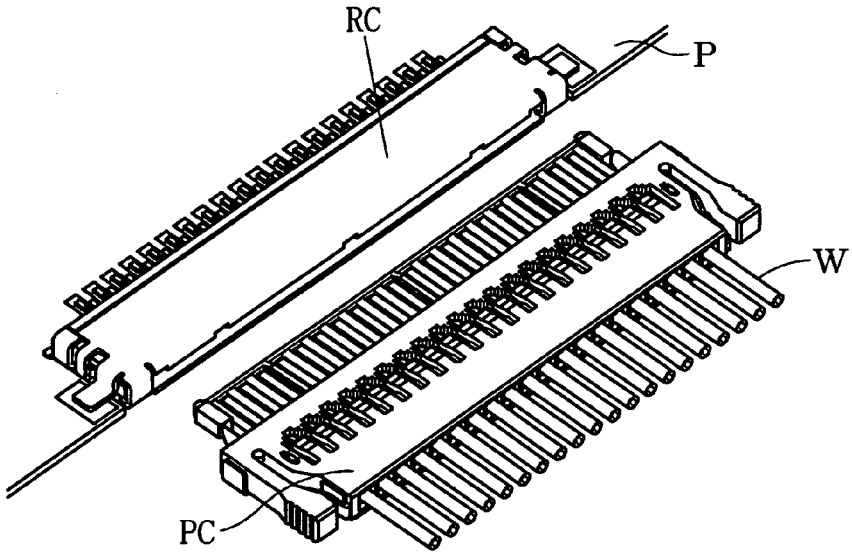
FIG. 19 is a perspective view showing the state of connecting the plug connector of the first embodiment to the receptacle connector mounted on a printed circuit board.
Figure 20:
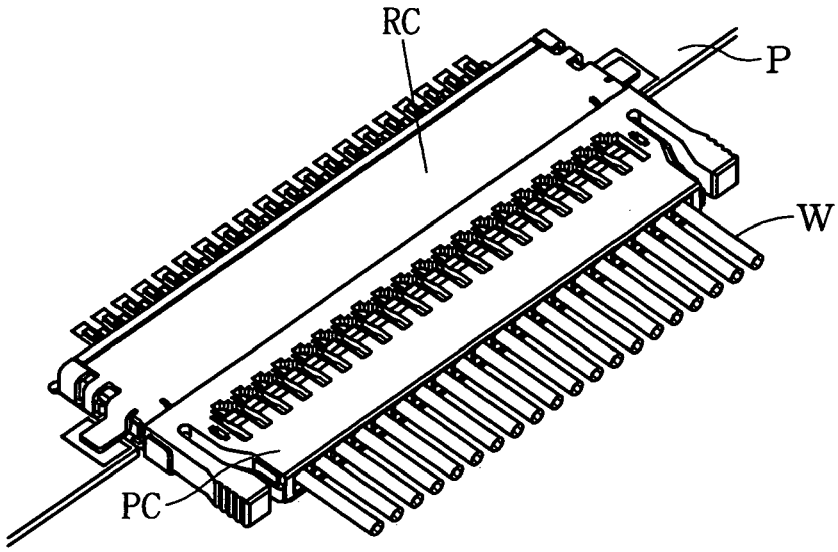
FIG. 20 is a perspective view showing the plug connector of the first embodiment, which has been connected to the receptacle connector mounted on the printed circuit board.
Figure 21:
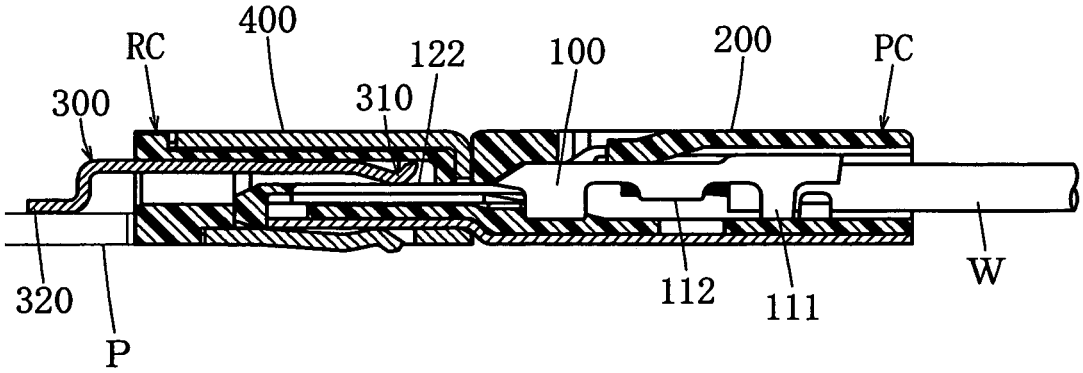
FIG. 21 is a sectional view of the plug connector of the first embodiment, which has been connected to the receptacle connector. They are sectioned in a plane perpendicular to the width direction and seen in the width direction.

As shown in FIG. 19 through FIG. 21, when the tabs 120 and the supporting wall 220 of the plug connector PC are inserted into the cavity 410 of the receptacle connector RC, and the contact parts 310 of the electric contacts 300 of the receptacle connector RC are made to contact the contact plates 122 of the tabs 120, the electric contacts 100 of the plug connector and the electric contacts 300 of the receptacle connector will make mechanical connection and electric connection.

In that case, as the base plates 121 of the tabs 120 are supported by the supporting wall 220 of the housing 200, there will be no deformation of the tabs 120 due to the contact pressure between the tabs 120 and the electric contacts 300 of the receptacle connector. Thus generation of troubles, namely, defective fitting-in and failure of fitting-in between the plug connector PC and the receptacle connector RC, is prevented.

The tab 120 of the electric contact 100 comprises the base plate 121 and the contact plate 122, which are two plates produced by folding a part of the blank B and overlapping them in the thickness direction. Hence the strength of the tab 120 is increased even if the thickness of the blank B is set smaller to secure the thin-wire-crimping function of the insulation barrel 111 and the wire barrel 112. Moreover, as the protruding part 121*a* is fitted on the fitting wall 240 of the housing 200, the tab 120 will not lift in the thickness direction from the supporting wall 220 of the housing 200. Thus defective fitting-in and failure of fitting-in between the plug connector PC and the receptacle connector RC are prevented by preventing deformation through enhancing the strength of the tabs 120 and preventing lifting of the tabs 120 from the supporting wall 220.

When the tabs 120 of the electric contacts 100 and the supporting wall 220 of the housing 200 are inserted together into the cavity 410 of the receptacle connector RC, the top end wall 230 will push away the contact parts 310 of the electric contacts 300 of the receptacle connector in the thickness direction. Hence connection between both connectors PC, RC can be done smoothly.

In the case of the electric contact of the present invention, the position of the boundary line for folding two plates that constitute the tab is not limited. In the electric contact 100 of the first embodiment thereof the base plate 121 and the contact plate 122 are folded along a boundary line 123 that extends in the depth direction at one edge in the width direction. With this arrangement, the strength of the tab 120 is high when the tab 120 is subjected to a bending moment around an axis extending in the width direction. Moreover, the length of the blank B in the longitudinal direction of the tab 120 gets shorter.

In the case of the electric contact 100 of the first embodiment, a part of the body 110 adjacent to the tab 120 is greater at least in one of the width direction dimension and the thickness direction dimension than the tab 120, providing a fitting-in part 113 that fits into the receiving cell 211 of the housing 200. With this arrangement, as the protruding part 121*a* is fitted on the housing 200 and the fitting-in part 113 is fitted into the receiving cell 211, the electric contact 100 is prevented from tilting against the housing 200 when seen in the width direction and from turning relative to the housing 200 around an axis extending in the depth direction. This turning prevention function is effective, for example, when the electric contact is crimped to a twisted electric wire.

In the case of the housing of the present invention, it includes embodiment wherein at least one of both sides in width direction of the tab of the electric contact is open. In the case of the housing 200 of the first embodiment, cross walls 250 rising in the thickness direction are provided on both sides in the width direction of the part of the supporting wall 220 for supporting the base plate 121 of the electric contact 100. With this arrangement, the tab 120 is prevented from swaying in the width direction by the cross walls 250.

In the case of the electric contact 100 of the first embodiment, the thickness of the fitting wall 240 is made substantially equal to the thickness of the blank B of the electric contact 100. The contact part 310 of the electric contact 300 of the receptacle connector undergoes elastic deformation in the thickness direction by a certain stroke to obtain a contact pressure against the electric contact 100 of the plug connector. However, if there is gap between the contact plate 122 and the fitting wall 240, the contact part 310 of the electric contact 300 of the receptacle connector has to be able to undergo elastic deformation by a greater stroke than the stroke to overcome the gap. This makes it more difficult to design the electric contact 300 of the receptacle connector and increases the thickness of the receptacle connector. In contrast to this, in the case of the first embodiment, the stroke of the elastic deformation of the contact part 310 of the electric contact 300 of the receptacle connector is the required minimum, making it easier to design the electric contact 300 of the receptacle connector and allowing reduction in thickness of the receptacle connector RC.

Figure 22:
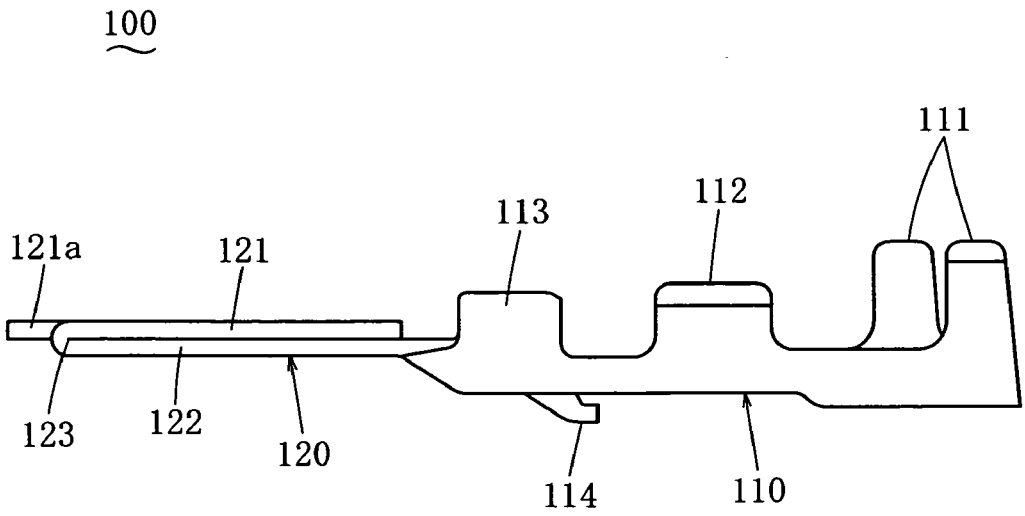
FIG. 22 is a view of the electric contact of the second embodiment seen in the width direction.
Figure 23:
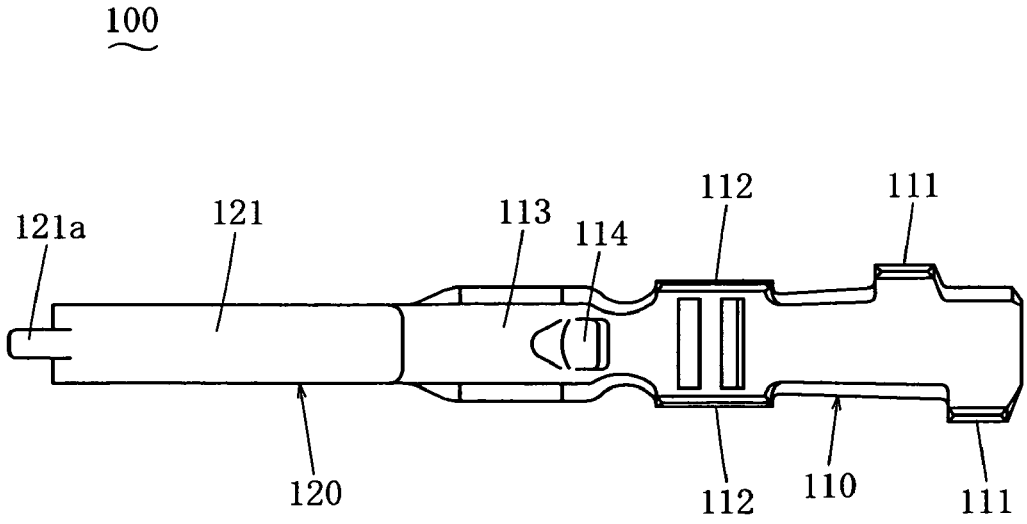
FIG. 23 is a view of the electric contact of the second embodiment seen in the thickness direction.
Figure 24:
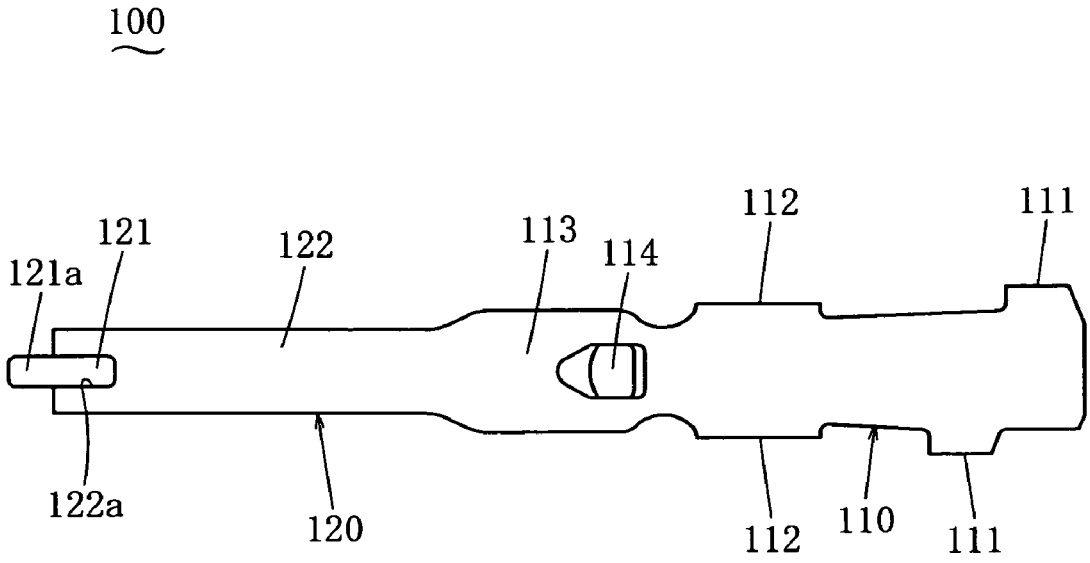
FIG. 24 is a view of the electric contact of the second embodiment seen from the opposite side in the thickness direction.
Figure 25:
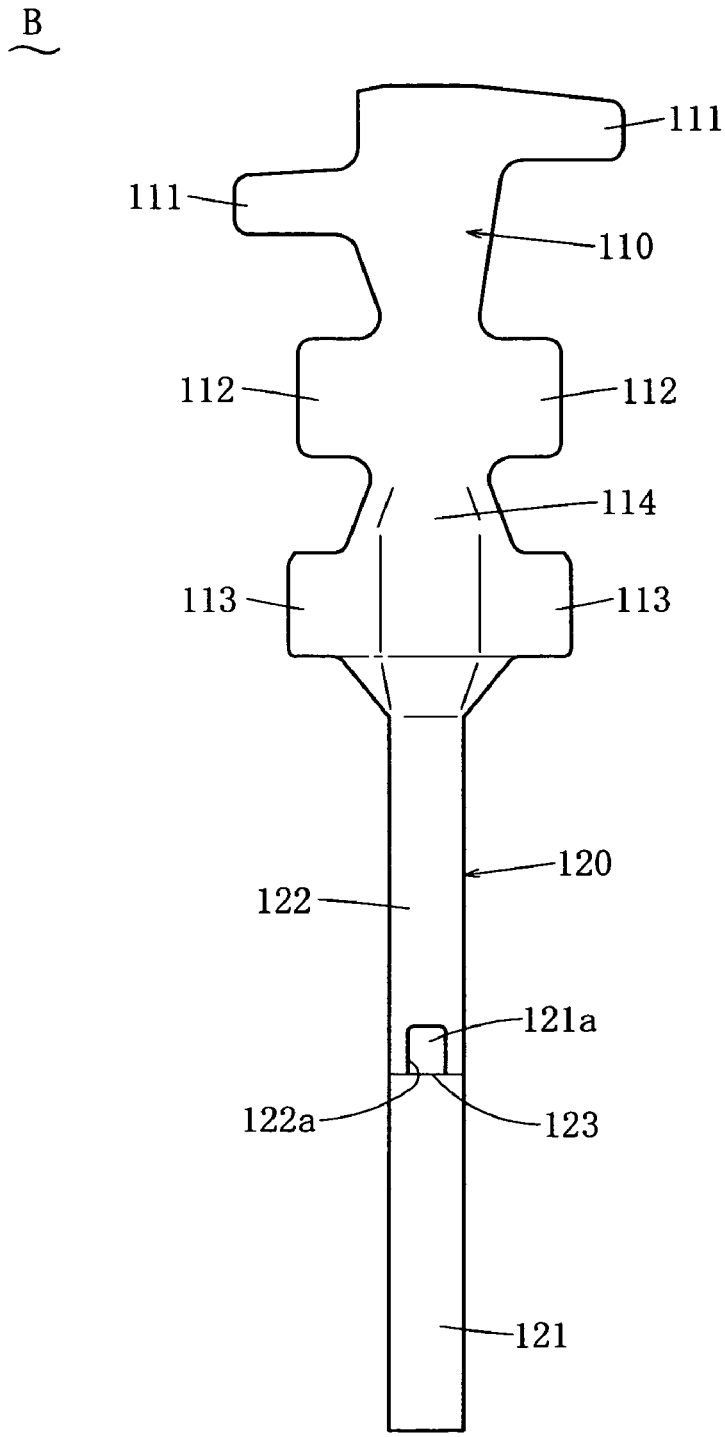
FIG. 25 is a view showing the blank of the electric contact of the second embodiment.

Next, some other embodiments will be described. FIG. 22 through FIG. 24 show the second embodiment of the electric contact. In the case of the electric contact 100 of the first embodiment, the base plate 121 and the contact plate 122 are folded along the boundary line 123 extending in the depth direction at one edge in the width direction. In contrast to this, in the electric contact 100 of the second embodiment, the base plate 121 and the contact plate 122 are folded along a boundary line 123 extending in the width direction on the rear side in the depth direction. As shown in FIG. 25, in the blank B the protruding part 121*a* being a part of the base plate 121 is in the domain of the contact plate 122. When the base plate 121 of the blank B is folded to overlap it with the contact plate 122 in the thickness direction, the protruding part 121*a* will protrude rearward beyond the rear end in the depth direction of the contact plate 122, and a hole 122*a*, which has been produced by cutting out the protruding part 121*a*, will remain in the contact plate 122. Other construction is similar to the electric contact 100 of the first embodiment.

With this arrangement, the tab 120 exhibits high strength when the tab 120 is subjected to a torsional moment around an axis extending in the depth direction. Moreover, the length of the blank B in the transverse direction of the tab 120 is shortened. Other actions and effects are identical to those of the electric contact 100 of the first embodiment.

Figure 26:
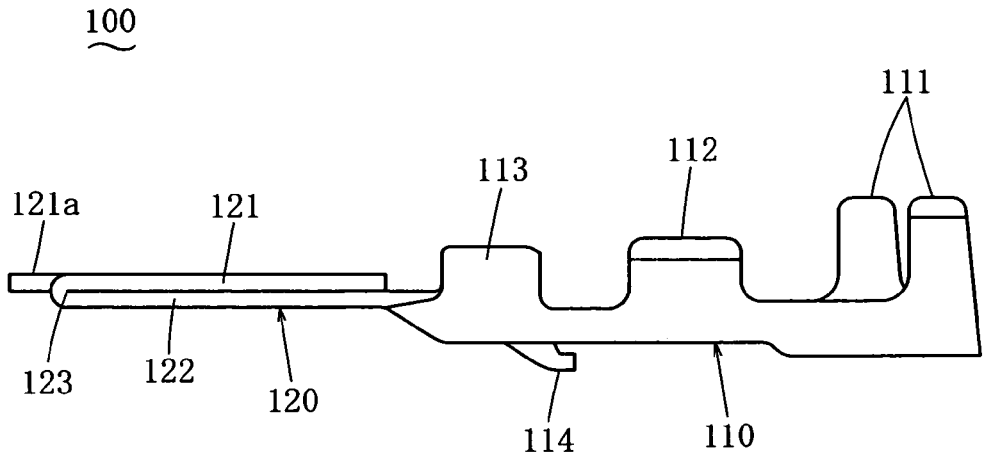
FIG. 26 is a view of the electric contact of the third embodiment seen in the width direction.
Figure 27:
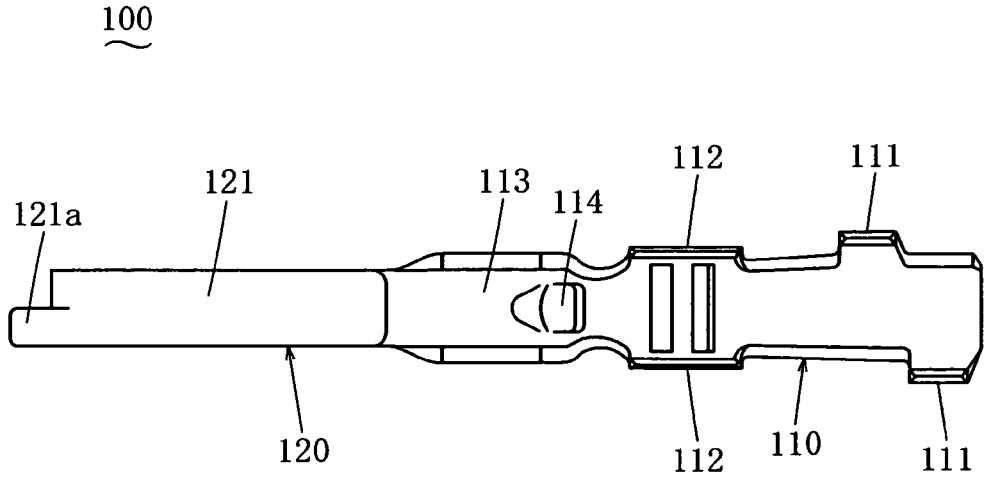
FIG. 27 is a view of the electric contact of the third embodiment seen in the thickness direction.
Figure 28:
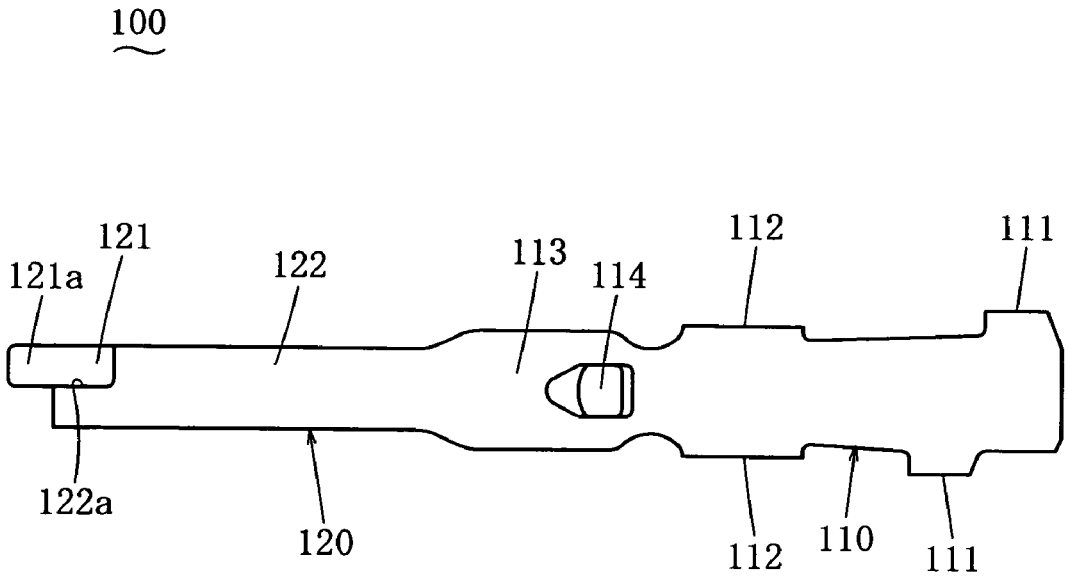
FIG. 28 is a view of the electric contact of the third embodiment seen from the opposite side in the thickness direction.

FIG. 26 through FIG. 28 show the third embodiment of the electric contact. The electric contact 100 of the third embodiment is a modification of the electric contact 100 of the second embodiment. In the second embodiment the protruding part 121*a* is provided at the center in the width direction of the base plate 121, but in the third embodiment the protruding part 121*a* is provided at one end in the width direction of the base plate 121. Other construction is similar to that of the electric contact 100 of the second embodiment. The actions and effects obtained are identical to those of the electric contact 100 of the second embodiment.

The present invention includes embodiments wherein features of the embodiments described above are combined.

With the description of these embodiments, the first electric contact of plug connector and the first housing of plug connector, which were described in the summary of the invention, were fully disclosed. Moreover, with the description of these embodiments, the second through fourth electric contacts of plug connector and the second through fourth housings of plug connector of the present invention, which will be explained below, were fully described. Also, the first housing of plug connector into which any electric contact of plug connector of the second through fourth electric contact of plug connector is inserted and on which the electric contact is fitted was fully described. The present invention includes these electric contacts of plug connector and housings of plug connector.

The second electric contact of plug connector is the first electric contact of plug connector, wherein the base plate and the contact plate are folded along a boundary line extending in the depth direction at one edge in the width direction.

With this arrangement, the tab exhibits a high strength when the tab is subjected to a bending moment around an axis extending in the width direction. The length of the blank in the longitudinal direction of the tab is shortened.

Accordingly, the strength of the tab can be increased against a bending moment working on the tab around an axis extending in the width direction, so as to prevent the tab from being deformed. Moreover, the length of the blank can be reduced in the longitudinal direction of the tab.

The third electric contact of plug connector is the first electric connector of plug connector, wherein the base plate and the contact plate are folded along a boundary line extending in the width direction on the rear side in the depth direction.

With this arrangement, the tab exhibits a high strength when the tab is subjected to a torsional moment around an axis extending in the depth direction. The length of the blank in the transverse direction of the tab is shortened.

Accordingly, the strength of the tab can be increased against a torsional moment working on the tab around an axis extending in the depth direction, so as to prevent the tab from being deformed. Moreover, the length of the blank in the transverse direction of the tab can be shortened.

The fourth electric contact of plug connector is any one of the first through third electric contacts of plug connector, wherein a part of the body being adjacent to the tab is greater at least in one dimension of the dimension in the width direction and the dimension in the thickness direction than that of the tab to provide a fitting-in part for fitting in the receiving cell of the housing.

With this arrangement, as the protruding part is fitted on the housing and the fitting-in part is fitted into the receiving cell, the electric contact is prevented from tilting in relation to the housing when seen in the width direction, and the electric contact is prevented from turning in relation to the housing around an axis extending in the depth direction.

Accordingly, as the protruding part is fitted on the housing and the fitting-in part is fitted into the receiving cell, the electric contact can be prevented from tilting in relation to the housing when seen in the width direction, and the electric contact can be prevented from turning in relation to the housing around an axis extending in the depth direction.

The second housing of plug connector is the first housing of plug connector, wherein cross walls rising in the thickness direction are provided on both sides in the width direction of a part of the supporting wall for receiving the base plate of the electric contact.

With this arrangement, the tab is prevented from swaying in the width direction of the tab by the cross walls.

Accordingly, the tab can be prevented from swaying in the width direction of the tab by the cross walls, and defective fitting-in between the plug connector and the receptacle connector can be prevented.

The third housing of plug connector is the first or the second housing of plug connector, wherein the thickness of the fitting wall is substantially identical to the thickness of the blank of the electric contact.

The electric contact of the receptacle connector undergoes elastic deformation in the thickness direction by a certain stroke to obtain the contact pressure against the electric contact of the plug connector. However, if there is a gap between the contact plate and the fitting wall, the electric contact of the receptacle connector has to undergo elastic deformation by a stroke exceeding the stroke to overcome the gap. This makes it more difficult to design the electric contact of the receptacle connector and increases the thickness of the receptacle connector. In contrast to it, with this arrangement, the stroke of elastic deformation of the electric contact of the receptacle connector is reduced to a minimum required, designing the electric contact of the receptacle connector is easier, and the thickness of the receptacle connector may be reduced.

Accordingly, the stroke of elastic deformation of the electric contact of the receptacle connector can be reduced to the minimum required, designing the electric contact of the receptacle connector can be made easier, and the thickness of the receptacle connector can be reduced.

The fourth housing of plug connector is any housing of plug connector of the first through third housings of plug connector, into which the fourth electric contact of plug connector is inserted and on which the fourth electric contact of plug connector is fitted, and this housing is provided with an accepting part into which the fitting-in part of the electric contact is fitted at the rear end of the receiving cell of the receiving body.

In the case of this housing of plug connector, as the protruding part is fitted on the fitting wall of the housing and the fitting-in part is fitted in the accepting part, the electric contact is prevented from tilting in relation to the housing when seen in the width direction, and the electric contact is prevented from turning in relation to the housing around an axis extending in the depth direction.

Accordingly, in this housing of plug connector, as the protruding part is fitted on the fitting wall of the housing and the fitting-in part fits in the accepting part, the electric contact can be prevented from tilting in relation to the housing when seen in the width direction, and the electric contact can be prevented from turning in relation to the housing around an axis extending in the depth direction.

What is claimed is:

1. An electric plug connector including an electric contact fitted in a housing, wherein:

said electric contact comprises an elongated contact body that extends longitudinally in a longitudinal direction;

said contact body comprises a crimping barrel that is adapted to receive and be crimped onto an electric wire, and a contact tab that extends in said longitudinal direction from said crimping barrel and that is adapted to make contact with a counterpart connector contact;

said contact tab comprises a base plate and a contact plate that are integral and unitary with one another through a folded junction and that are folded flat with respect to one another along said folded junction so as to overlap and reinforce one another;

said contact tab further comprises a protruding part that protrudes integrally and unitarily from an end of said base plate in said longitudinal direction opposite said crimping barrel, so that said protruding part protrudes beyond an end of said contact plate in said longitudinal direction opposite said crimping barrel;

said housing includes a housing body that defines therein a receiving cell in which at least a portion of said crimping barrel of said electric contact is received, a support wall that extends in said longitudinal direction from said housing body and that has a support wall surface which supports said base plate of said electric contact extending therealong, and a retaining part that is connected to said support wall at an end thereof opposite said housing body in said longitudinal direction;

said retaining part is spaced from said support wall surface at a spacing distance to receive said protruding part of said contact tab therebetween; and said protruding part of said contact tab is received between said retaining part and said support wall and is held by said retaining part to prevent said contact tab from deflecting away from said support wall.

2. The electric plug connector according to claim 1, wherein said folded junction is a tight fold so that said base plate and said contact plate extend flat and planar in contact with one another so as to form a doubled plate structure of said contact tab.

3. The electric plug connector according to claim 1, wherein said folded junction extends in said longitudinal direction.

4. The electric plug connector according to claim 1, wherein said folded junction extends transversely relative to said longitudinal direction at said ends of said base plate and said contact plate.

5. The electric plug connector according to claim 1, wherein said contact body further comprises a fitting-in part adjacent to said contact tab, said fitting-in part is larger than said contact tab in at least one of a width direction and a thickness direction respectively orthogonal to said longitudinal direction, and said fitting-in part is fitted into said receiving cell of said housing.

6. The electric plug connector according to claim 5, wherein said housing body comprises an accepting part into which said fitting-in part of said contact body is fitted, wherein said accepting part is provided at a rear end of said receiving cell of said housing.

7. The electric plug connector according to claim 1, wherein said retaining part comprises a fitting wall, said housing further includes an end wall that rises in a height direction from said support wall surface of said support wall at said end thereof, said fitting wall extends in said longitudinal direction from said end wall toward said housing body, said fitting wall is spaced from said support wall surface of said support wall in said height direction by a distance equal to or greater than a thickness of said protruding part of said contact tab, and said fitting wall contacts said protruding part of said contact tab to prevent said contact tab from deflecting away from said support wall.

8. The electric plug connector according to claim 7, wherein said housing further comprises cross walls that rise in said height direction and extend in said longitudinal direction along two sides of said support wall and that receive said base plate of said electric contact therebetween.

9. The electric plug connector according to claim 7, wherein said fitting wall has a thickness substantially identical to a thickness of said contact plate of said contact tab.

* * * * *